United States Patent [19]

Knapp

[11] 4,040,569

[45] Aug. 9, 1977

[54] ELECTRO-MAGNETIC FUEL INJECTION VALVE

[75] Inventor: Heinrich Knapp, Leonberg, Germany

[73] Assignee: Robert Bosch GmbH, Stuttgart, Germany

[21] Appl. No.: 655,877

[22] Filed: Feb. 6, 1976

[30] Foreign Application Priority Data

Feb. 26, 1975 Germany ..... 2508390

[51] Int. Cl.[2] ..... F02M 51/08

[52] U.S. Cl. ..... 239/467; 239/585

[58] Field of Search ..... 239/86, 88-91, 239/93-96, 102, 463, 464, 467, 472, 473, 451-453, 459, 533, 584, 585; 123/32 AE

[56] References Cited

U.S. PATENT DOCUMENTS

| | | | |
|---|---|---|---|
| 3,241,768 | 3/1966 | Croft | 239/585 X |
| 3,450,353 | 6/1969 | Eckert | 239/585 |

FOREIGN PATENT DOCUMENTS

| | | | |
|---|---|---|---|
| 68,007 | 10/1940 | Czechoslovakia | 239/585 |

*Primary Examiner*—Evon C. Blunk
*Assistant Examiner*—Andres Kashnikow
*Attorney, Agent, or Firm*—Edwin E. Greigg

[57] ABSTRACT

An electro-magnetic fuel injection valve for low pressure fuel injection systems of internal combustion engines utilizing induction tube injection which includes a housing, a stationary iron core located within the housing, with the core supporting a magnetic winding, an armature-plunger concentric with respect to the iron core, a valve needle, a hollow stem connected to the housing into which the valve needle extends and a valve seat defining structure for the valve needle situated within the hollow stem. The valve seat defining structure having a plurality of bores formed therein the dimensions of which determine the apportionment of fuel by the fuel injection valve, and the disposition of which permits utilization of the kinetic energy, which results from the transformation of the pressure energy during the fuel apportionment, in the preparation of the fuel.

7 Claims, 2 Drawing Figures

ELECTRO-MAGNETIC FUEL INJECTION VALVE

BACKGROUND OF THE INVENTION

The present invention relates to an electro-magnetic injection valve, and in particular to an electro-magnetic injection valve for timed low-pressure injection systems of internal combustion engines using induction tube injection.

The electro-magnetic injection valve of the invention has a housing, a stationary iron core located within the valve housing, with the core supporting a magnetic winding, an armature-plunger concentric with respect to the iron core, and being immersed in the fuel flow, and a valve needle, connected to the armature-plunger, for creating an injection-jet located at the end of a hollow stem connected to the valve housing.

Such electro-magnetic injection valves are well known. These well-known valves often employ needle-valves that open inward, which has the disadvantage that combustion-residues cause changes in the fuel quantities injected.

It has already been suggested that the location at which the fuel is apportioned be contained within the electro-magnetic injection-valve, and that the preparation of the fuel occur at the outward-opening valve-seat.

OBJECT AND SUMMARY OF THE INVENTION

It is a principal object of the present invention to locate the ejection-point formed at the injection-jet of an electro-magnetic injection-valve of the type described above, as near as possible to the intake-valve of the internal combustion engine, because wide spray cone angles, which assure a particularly good preparation of the fuel, can then be utilized. It is essential, however, that the moving mass of such a valve be very small. In addition, the pressure energy which is translated into velocity during the fuel apportionment should be used in the vaporization.

This object and others are achieved according to the present invention by lifting the valve needle via the armature-plunger of the magnet outwardly from its valve-seat, by the provision of bores lying in the flow path of the fuel, the dimensions of which determine the fuel apportionment, and further by the fact that the kinetic energy, into which the pressure energy was translated during the apportionment, may, through the particular arrangement of the bores, be utilized in the preparation of the fuel.

DESCRIPTION OF THE PREFERRED EMBODIMENT

Figures 1, 2:
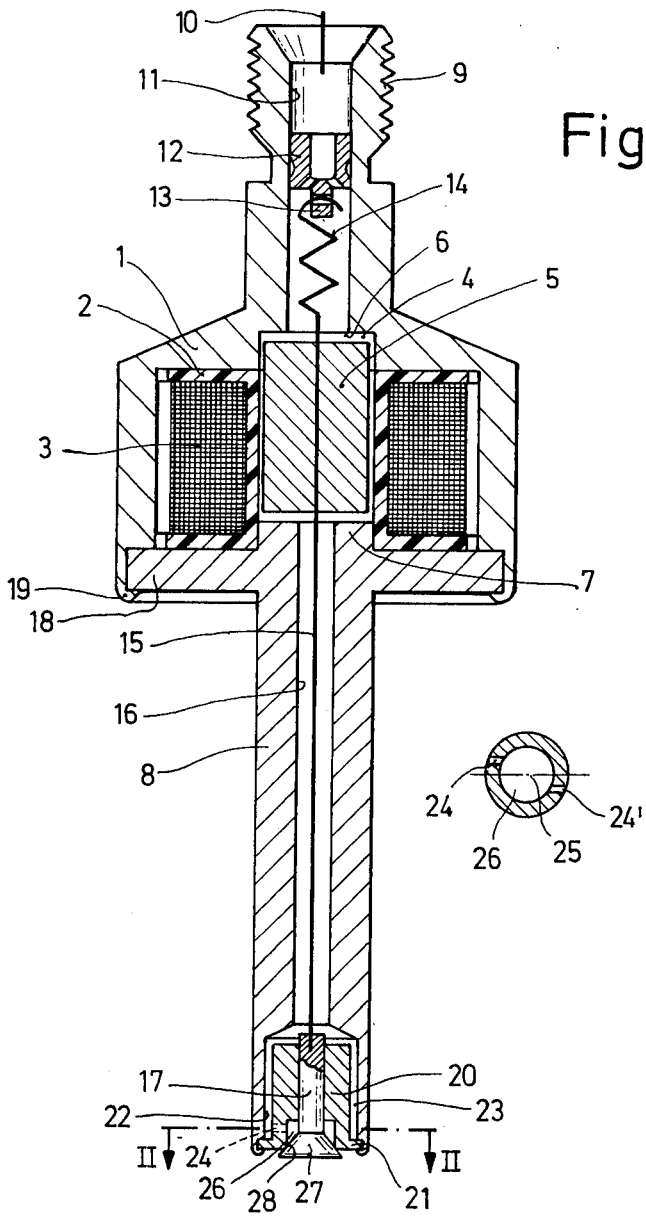
FIG. 1 illustrates a cross-section view in elevation of an electro-magnetic injection valve according to an embodiment of the invention.
FIG. 2 is a view taken in cross-section along the line II—II in FIG. 1.

The electro-magnetic injection-valve has a valve housing 1, which contains a magnetic coil 3, positioned on a coil-support 2.

An armature-plunger 5, may move within a space 4 surrounding the coil-support 2 whose axial extent is limited on the one hand by a housing-shoulder 6, and on the other hand by a central extension 7 of a hollow stem 8.

The valve housing 1 is built to be rotationally symmetrical, and possesses a concentric connecting-piece 9, for a line 10, coming from a fuel pump (not shown). Secured by wedging, for example, to the inside wall 11 of the connecting piece 9, is a hollow insert 12, which permits an axial flow of fuel. The insert 12 has an eye 13, into which is hung one end of a tension-spring 14. The tension-spring 14 can, as in the above form of construction, be made integral with a rod 15. But it is also possible to produce the tension-spring 14 and the rod 15 as separate pieces.

The rod 15 penetrates the armature-plunger 5 in such a manner that it is joined securely to the armature-plunger. The rod 15 lies in the middle of a longitudinal bore 16 of the hollow stem 8, and carries at its end a valve needle 17. The rod 15 can be made as a rigid component, but it is also possible to produce it from non-rigid wire.

The hollow stem 8 has a flange 18 with which it is set into the valve-housing 1, where it is fastened by the crimping of a valve-housing-rim 19. The material of the hollow stem 8 and the material of the rod 15 are either the same material, or the materials possess equal values of thermal coefficients of expansion.

The valve needle 17 is equipped with a hollow seat-member 20, which is installed at the free end of the hollow stem 8 by a flange 21. The hollow stem 8 is provided with a recess 22, the diameter and length of which recess are greater than the corresponding measurements of the seat-member 20. In this fashion, a cylindrical ring-gap 23 is formed along the surface of seat-member 20, and the inner wall of the hollow stem 8. Immediately ahead of the flange 21, the seat-member 20 has two short bores 24 and 24', which are, as the sectional view in FIG. 2 shows, mutually parallel, and positioned equidistantly from the axis 25. The bores 24 and 24' lead to, and enter, a space 26 in the seat-member 20, which, in the position drawn, is closed to the outside by the conical head 27 of the valve needle. The head 27 mates with a valve-seat 28 at the lower end of the seat-member 20. The seat-member 20 and valve needle 17 form the injection nozzle of the electro-magnetic injection-valve.

The operation is as follows:

In the illustrated position of the electro-magnetic injection-valve, the tension-spring 14 has pulled the armature-plunger 5 and the valve needle 17 upward. In this position, the injection-nozzle, is closed, and no fuel is supplied.

When an electrical current flows through the coil 3, the magnetic forces pull the armature-plunger 5 against the central extension 7, expanding the tension-spring 14. The rod 15 moves downward, and permits the outward lifting of the valve needle 17, with its head 27, from the valve-seat 28, opening the injection nozzle 17/20.

The fuel which has passed the connecting piece 9, and has entered the armature-plunger-space 4 and the hollow stem 8, and which is present, under pressure, behind the head 27 of the valve needle 17, can now be expelled downward, concurrent with which the valve-seat 28 is opened far enough that the open gap has no influence upon the apportionment. Rather, the apportionment is undertaken by the throttling of the flow through, and determined by the inside diameters of, the bores 24 and 24'. In this way, only the density of the fuel, and not its viscosity, affects the apportionment of the fuel. The vortex created by the off-setting of the bores 24 and 24' from the axis 25, and the discharge from the opened valve 27/28, have no effect upon the apportionment.

The vortex has a comparatively large conical angle of about 90°. Such large angles assure a very good preparation of the fuel. However, they require that the ejection-point be very near to the intake-valve of the combustion engine. This requirement is met by the comparatively great length of the hollow stem 8. Due to the low mass of the rod 15, which can, if desired, consist of a thin wire, the proximate placement of the ejection-point at the intake-valve, and the actuation of the valve needle 17, are possible even when the distance between the armature-plunger 5 and the ejection-point is comparatively large. When the rod 15 is made of non-rigid wire, it is drawn tight by the tension-spring 14 on the one hand, and on the other hand by the pressure exerted upon the head 27 of the valve needle 17. The precise setting of the device remains constant even during strong temperature changes, because the rod 15 and the hollow stem 8 are made of the same material, or else are made of materials having equal coefficients of thermal expansion.

The design described above additionally affords the avoidance of a further disadvantage of electro-magnetic injection-valved:

It is known that the output quantity of electro-magnetic valves in use today decreases at a high temperature, resulting in bad hot-starting. It is known from other designs that this advantage can be avoided whenever the fuel flows through the magnetic valve up to its seat. Such a solution is achievable for the present invention in a manner, not shown in the drawing, in which the fuel is, for example, guided through an additional concentric tube through the hollow stem 8, down to the valve needle 17, and then returned upward in a second connection-piece. In that manner, a flushing of the electro-magnetic valve with cool fuel can readily begin as the fuel pump is switched on, so that hot-starting conditions are substantially improved.

In a preferred embodiment of the electromagnetic valve the bores 24 and 24' could have a caliber of 0.2 – 0.3 mm for an injection pressure of 2 bar. Such an arrangement causes a pressure transformation, which creates a flow resistant which is dependent solely upon the density of the fluid. The arrangement and diameters of bores 24 and 24' create a vortex in the space 26, which is without counterpressure and which does not influence the apportionment of the fuel.

When leaving the valve-seat 28 the energy of the vortex is converted into the energy required to atomize the fuel.

What is claimed is:

1. In an electro-magnetic injection valve for timed low pressure fuel injection systems of internal combustion engines utilizing induction tube injection, including; a housing; a stationary iron core located within the housing; a fixed magnetic winding supported within the housing by the iron core; an armature-plunger mounted within the housing in co-axial relationship with the iron core, said armature-plunger being immersed by the fuel within the housing; a hollow stem connected to the housng; means within the hollow stem which define a valve seat; and a valve needle connected to the armature-plunger and forming an injection nozzle with the valve seat, the improvement comprising: a non-rigid wire rod which connects the valve needle to one end of the armature-plunger, said rod being immersed by the fuel within the valve; tension means connecting the other end of the armature-plunger to the housing, said tension means and the fuel pressure at the valve needle placing the non-rigid wire rod and armature-plunger under tension; and a plurality of bores formed within the valve seat defining means which are dimensioned to determine the apportionment of fuel by the injection nozzle and are appropriately disposed to transform the pressure energy associated with the fuel apportionment into kinetic energy for utilization in the preparation of the fuel, wherein:

i. the valve seat defining means is formed as a hollow member within the free end of the hollow stem where it is immersed by the fuel within the valve, said hollow member having a central axis about which a circumferential surface lies which defines an annular cylindrical space with the interior wall of the hollow stem;

ii. the plurality of bores comprising two mutually parallel disposed bores each serving as a throttle and each being formed within the wall of the hollow member to extend inwardly toward the central axis, with each bore being disposed at the same distance from the central axis; and iii. the valve needle is lifted outwardly from its valve seat by the movement of the armature-plunger and non-rigid wire rod as a unit.

2. The electro-magnetic fuel injection valve as defined in claim 1, wherein fuel preparation is achieved by the transformation of kinetic energy into atomization energy and wherein kinetic energy is transformed into the atomization energy by the generation of a vortex flow.

3. The electro-magnetic injection valve as defined in claim 1, wherein the rod and the hollow stem are constructed of material with the same characteristics of thermal expansion.

4. The electro-magnetic injection valve as defined in claim 1, wherein the non-rigid wire comprises a thin wire rod of low mass, wherein the fuel preparation is achieved by the transformation of kinetic energy into atomization energy, and wherein kinetic energy is transformed into the atomization energy by the generation of a vortex flow with the flow from the injection valve past the valve seat forming a cone whose angle is approximately 90°.

5. In an electro-magnetic injection valve for timed low pressure fuel injection systems of internal combustion engines utilizing induction tube injection, including; a housing, a stationary iron core located within the housing; a fixed magnetic winding supported within the housing by the iron core; an armature-plunger mounted within the housing in co-axial relationship with the iron core, said armature-plunger being immersed by the fuel within the housing; a hollow stem connected to the housing; means within the hollow stem which define a valve seat; and a valve needle connected to the armature-plunger and forming an injection nozzle with the valve seat, the improvement comprising: a plurality of bores formed within the valve seat defining means which are dimensioned to determine the apportionment of fuel by the injection nozzle and are appropriately disposed to transform the pressure energy associated with the fuel apportionment into kinetic energy for utilization in the preparation of the fuel, wherein the valve needle is lifted outwardly from its valve seat by the armature-plunger; a thin rod which connects the valve needle to the armature-plunger, said rod being of low mass and extending coaxially within the hollow stem, wherein the direction of attraction of the armature-plunger due to magnetic force is the same as the direction of flow of fuel as well as the direction of opening of the valve needle; and a tension spring, wherein the rod penetrates the armature-plunger and extends through the other side of the armature-plunger into engagement with the tension spring which acts in the direction opposite to the direction of attraction of the armature-plunger.

6. The electro-magnetic injection valve as defined in claim 5, wherein one side of the tension spring is attached within the valve housing, and wherein the spring serves as a return spring for the armature-plunger and the valve needle.

7. The electro-magnetic fuel injection valve as defined in claim 6, wherein the improvement further comprises a hollow insert to which the other end of the tension spring is attached and a hollow connecting piece within the valve housing, and wherein the hollow insert is fastened to the interior wall of the hollow connecting piece and permits free axial flow of fuel.

* * * * *